US006168347B1

(12) United States Patent
Milot et al.

(10) Patent No.: US 6,168,347 B1
(45) **Date of Patent: *Jan. 2, 2001**

(54) SET OF PAVING STONES

(75) Inventors: Eric Milot, Montreal; Pierre Wilkie, Blainville, both of (CA)

(73) Assignee: Groupe Permacon Inc., Ville d'Anjou (CA)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/259,674

(22) Filed: Mar. 1, 1999

(30) Foreign Application Priority Data

Feb. 27, 1998 (CA) ..... 2230642

(51) Int. Cl.[7] ..... C01C 5/06
(52) U.S. Cl. ..... 404/34; 404/42
(58) Field of Search ..... 404/34, 39, 41, 404/42; D25/113, 118, 151

(56) References Cited

U.S. PATENT DOCUMENTS

D. 159,255 * 7/1950 Decker, Sr. et al. .
708,470 * 9/1902 Flood .
847,471 * 3/1907 Gross .
889,692 * 6/1908 Kratzer .
2,323,848 * 7/1943 Schaeffer .
5,533,827 7/1996 Scheiwiller ..... 404/38

FOREIGN PATENT DOCUMENTS

G8701270 3/1987 (DE) .
0274344 7/1988 (EP) .

* cited by examiner

*Primary Examiner*—Eileen D. Lillis
*Assistant Examiner*—Gary Hartmann
(74) *Attorney, Agent, or Firm*—Foley & Lardner

(57) ABSTRACT

A set of paving blocks wherein each block is a prism having side and end walls that are irregular in outline but are contained only within a respective virtual rectangular perimeter. The rectangular perimeter has a length L in a X axis and a width W in a Y axis at right angle to the X axis. At least two spaced apart parallel sections of the prism extend between the side walls, parallel to the Y axis and terminate at the virtual rectangular perimeter, such that each section has a width equal to W and the prism has at least one section bisecting the virtual rectangle parallel to the X axis and terminating at a rectangular perimeter and having a length equal to L.

6 Claims, 3 Drawing Sheets

SET OF PAVING STONES

BACKGROUND OF THE INVENTION

1. Field of the Invention

The present invention relates to a paving stone and more particularly to a set of paving stones each of which might have a different configuration but can be laid out in rows to form a surface pattern of predetermined outline covered by the paving stones.

2. Description of the Prior Art

It is well known to provide a set of paving stones each having an identical shape or configuration, laid in a predetermined interlocking pattern or laid in rows of similar rectangular prisms. Many patents describe such paving stones. All such patents describe paving stones that are molded from the same or similar molds or are pairs or sets of complementary paving stones.

SUMMARY OF THE INVENTION

It is the aim of the present invention to provide a set of paving stones of irregular shapes or configuration but which can be laid in a predetermined pattern of rows.

It is a further aim of the present invention to provide a set of paving stones which are molded by a predetermined array of individual molds producing paving stones of individually different configurations, but which nevertheless can be laid in a pattern of orderly rows.

It is still a further aim of the present invention to provide a set of paving stones that have a natural random appearance while being able to be laid in orderly rows. Thus, the paving stones are randomly selected in any given row.

A construction in accordance with the present invention comprises a set of paving blocks with each block being a prism having side and end walls that are irregular in outline but are contained only within a respective virtual rectangular perimeter, wherein the rectangular perimeter has a length L in an X axis and a width W in the Y axis at right angle to the X axis; at least two spaced apart, parallel sections of the prism extend between the side walls, parallel to the Y axis and terminating at the virtual rectangular perimeter, such that each section has a width equal to W and the prism having at least one section which bisects the distance between the end walls, parallel to the X axis and terminating at the rectangular perimeter and having a length equal to L wherein L is a multiple of a constant d when d is equal to the distance between the at least two sections, and wherein the virtual rectangular perimeter of each prism has a width equal to W.

In a more specific embodiment of the present invention the length L of the virtual rectangular perimeter of each prism of the set is expressed as $L_1$ is equal to 3d; $L_2$ is equal to 4d; $L_3$ is equal to 5d; and $L_n$ is equal to (n+2)d.

More specifically, at least two of the blocks of a set have different configurations although each prism has a dimension T extending between a top and bottom surface of the prism along an axis Z, wherein the dimension W and T of each prism are constants.

In yet another more specific embodiment of the present invention the side and end walls of the prisms are non-linear.

Thus, a set of paving stones may be provided wherein each paving stone is a molded block and the blocks may appear to have different configurations, but since each block has side walls that are generally parallel and the outside width of each block is the same, the blocks may be laid in regular rows to form a pattern even though the length of each block might vary.

The sections represent the widest and longest extent of the block and in fact coincident with the sections are the contact areas of each block with other blocks. Thus, since the section planes extending in the Y axis are spaced apart at constant distances for each block, then no matter how long or short a block in one row will be, it will necessarily align itself along section planes of adjacent blocks in other rows, and therefore the contact areas of each block will be in contact with contact areas of adjacent blocks. Likewise, since the longest extent of the block in the X axis is at least along the section in a plane bisecting the block or rectangle, it will necessarily coincide with the contact points of each adjacent block in one row.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 4:
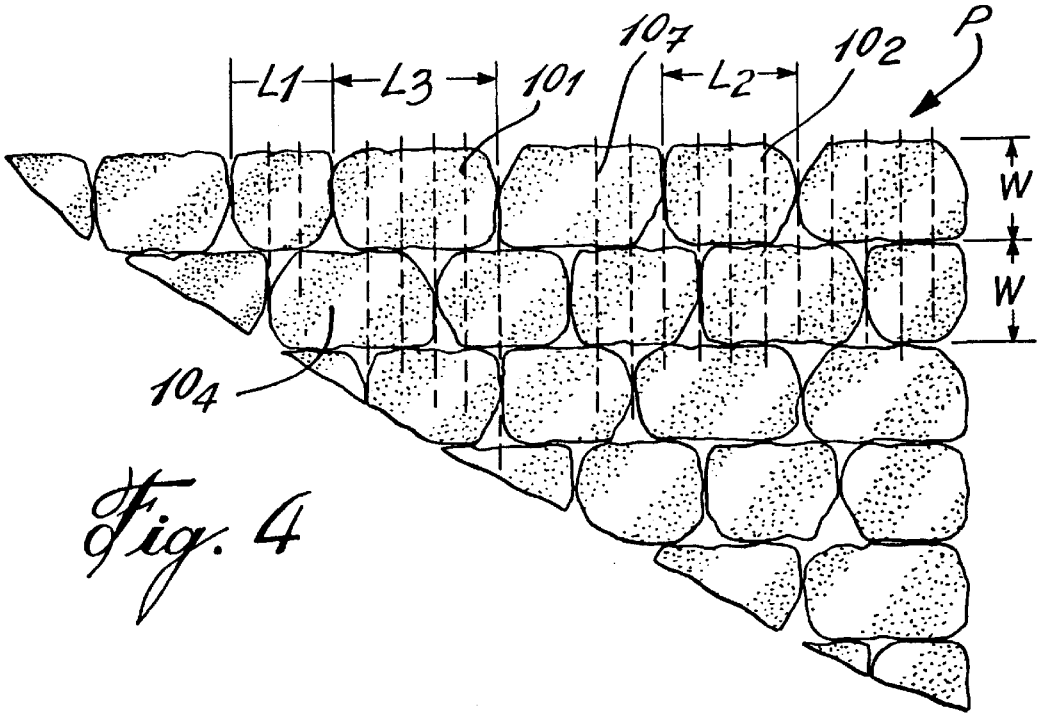
FIG. 4 is a fragmentary top plan view of paving stones laid out to form a patio.

Referring now to the drawings a set of paving stones as shown in FIG. 4 form a patio P with each of the stones T1, T2, T3, Tn laid out in rows.

Figure 1:
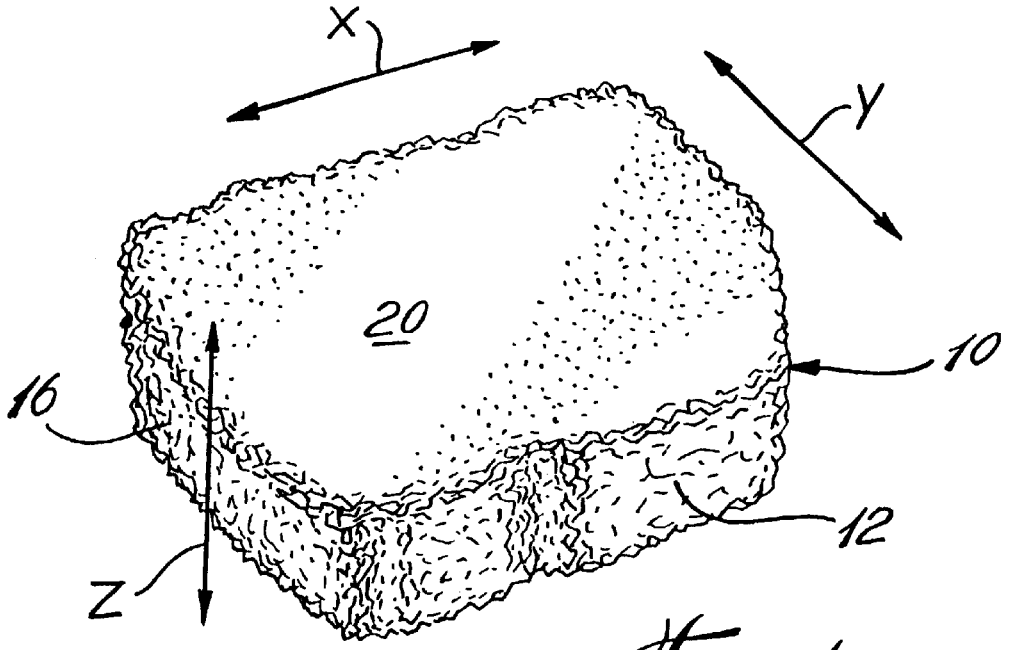
FIG. 1 is a perspective view of a block in accordance with the present invention.
Figure 2:
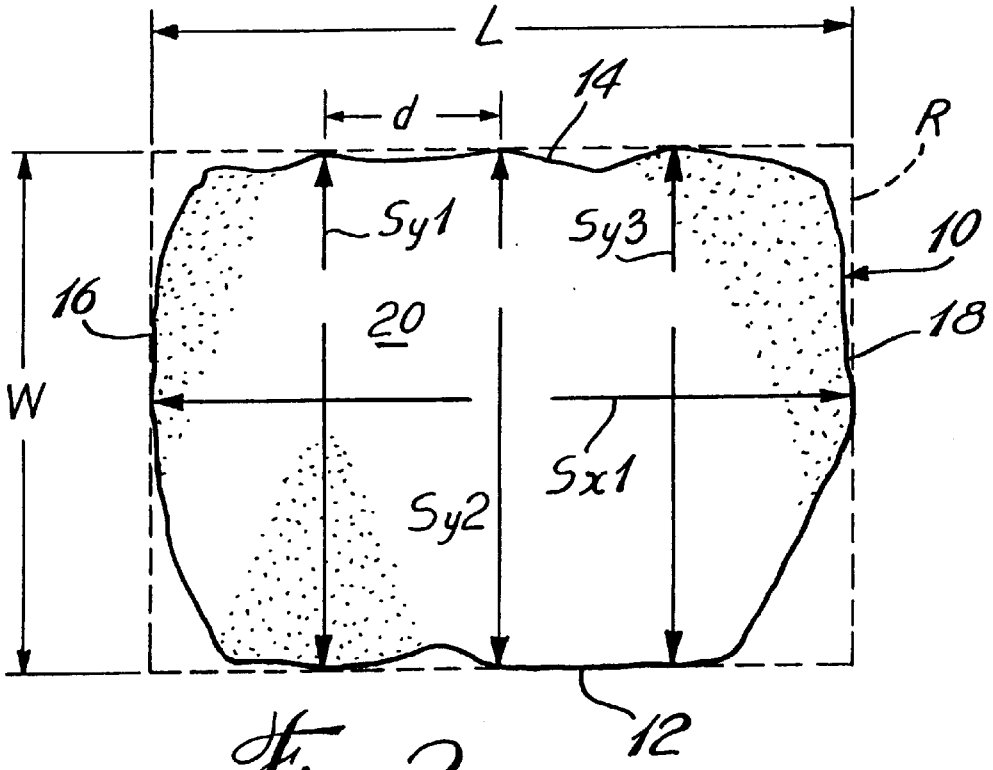
FIG. 2 is a top plan view of the block shown in FIG. 1.

FIGS. 1 and 2 illustrate a typical paving stone formed as a molded block 10. Block 10 is molded in the shape of a geometric prism having a top surface 20 parallel to a bottom surface, side walls 12 and 14 as well as end walls 16 and 18. The walls 12, 14, 16 and 18 of block 10 are purposely irregular to provide a natural stone appearance to the block. Each block may be molded in a separate mold and may also be submitted to a tumbling treatment.

However, the block 10 is molded within predetermined parameters. Each block fits within a virtual rectangular perimeter R shown in dotted lines in FIG. 2. This rectangular perimeter has a length L in the X axis and a width W in the Y axis. Three spaced apart sections $S_y1$, $S_y2$ and $S_y3$ extend the complete width W in the Y axis. There is no portion of the walls 12 or 14 that projects beyond the virtual rectangle.

In the X axis only one section $S_x1$ need extend the full extent of dimension L in the X axis. However the plane of section $S_x1$ will bisect the rectangle R of each block so that the contact point of each end of a block will abut the contact point of an adjacent block in a row.

The distance between each section $S_y1$, $S_y2$ and $S_y3$ is "d". Distance "d" is a constant. In one example d=40 mm.

As shown in FIG. 4, the length L of each block may be different. However, the width W of each block $\mathbf{10}_1$, $\mathbf{10}_2$, $\mathbf{10}_3$, and $\mathbf{10}_n$ must be the same in order to form regular rows. Likewise it is necessary to have at least two sections in the Y axis which are spaced apart a distance "d" to provide parallel planes coincident with the virtual rectangular perimeter R so as to allow orderly rows of width W.

Each block $\mathbf{10}_1$, $\mathbf{10}_2$, $\mathbf{10}_3$ and ln must have a length L which is a multiple of d but where the minimum $L_n$ equals (n+2)d. As shown in FIG. 2 the block 10 has a length equal to 4d and this represents 3 equally distance d sections $S_y1$, $S_y2$ and $S_y3$. The distance between each section is d. The purpose of the relationship of the length of the blocks as being (n+2)d is to ensure blocks 10, in each row, abut with blocks of different lengths in other rows at sections $S_1$, $S_2$, and $S_n$. Thus, blocks 10 in the first row as shown in FIG. 4 will form orderly rows because the blocks 10 will always abut along sections S from one row to the other as sections S will always be aligned. In fact the perimeter areas coincident with the sections $S_y1$ $S_y2$, $S_x1$, etc. are the contact points with adjacent blocks in adjacent rows or in a row, as the case may be.

Figure 3A:
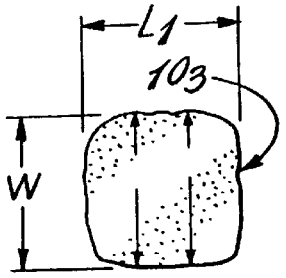
FIGS. 3*a* to 3*j* are top plan views of different shapes of blocks to form a set in accordance with the present invention.
Figure 3B:
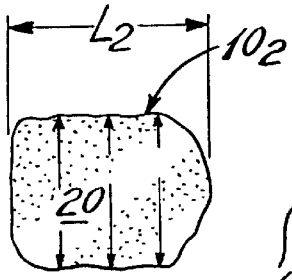
Figure 3C:
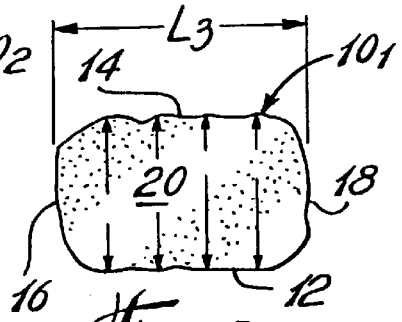
Figure 3D:
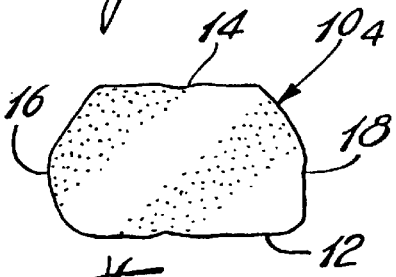
Figure 3E:
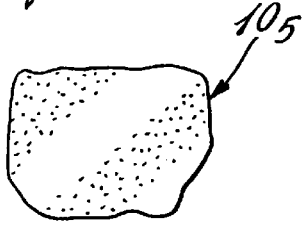
Figure 3F:
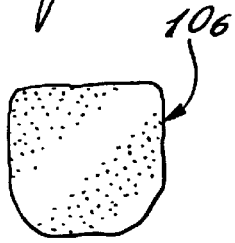
Figure 3G:
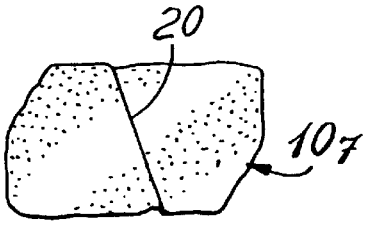
Figure 3H:
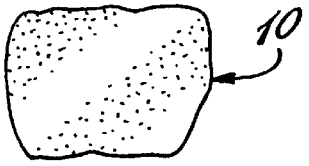
Figure 3I:
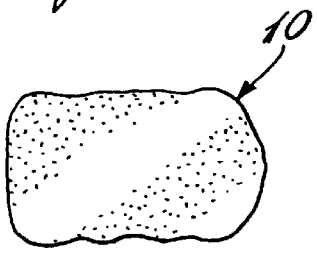
Figure 3J:
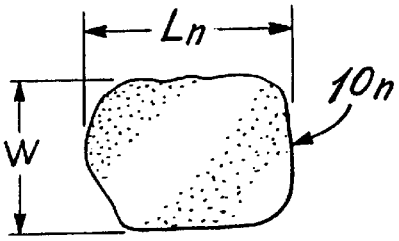

Block $\mathbf{10}_7$ shown in FIG. 3*g* may be provided with a dividing line 20 extending at an angle such that when the block is split along dividing line 20 it will produce two roughly trapezoidal sub-blocks which can be used to form a curved portion. The dividing line 20 could be designated by a groove.

Figure 5:
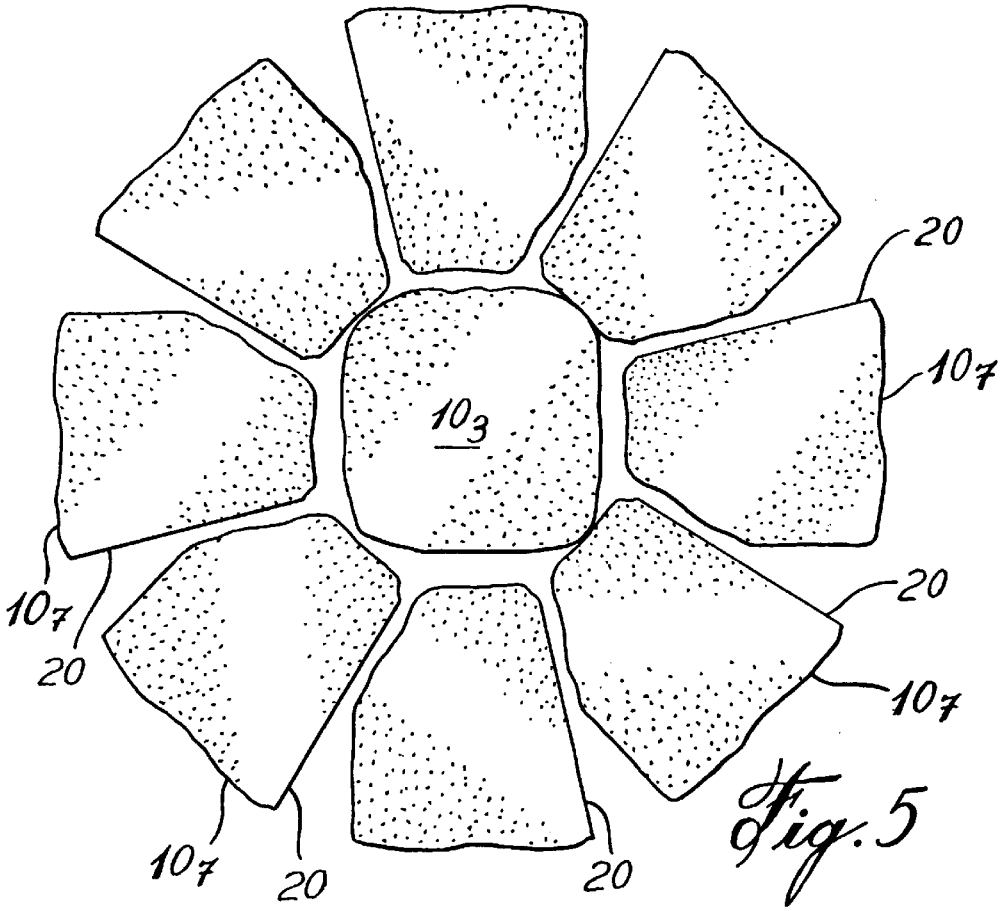
FIG. 5 is a top plan view of an arrangement of paving stones according to the present invention.

FIG. 5 shows a specific pattern utilizing block $\mathbf{10}_3$ as a center piece and a plurality of half-segments of blocks $\mathbf{10}_7$. The blocks $\mathbf{10}_7$ as shown in FIG. 3*g* would previously have been split along dividing line 20 forming two segments. These are the segments that are utilized in FIG. 5. Block $\mathbf{10}_6$ of FIG. 3*f* could also be utilized for the center piece.

In order to use the blocks for paving stones, it is necessary that the thickness T be constant for each block.

We claim:

1. A set of paving blocks wherein each block is a prism having side and end walls that are irregular in outline but are contained only within a respective virtual rectangular perimeter, wherein the rectangular perimeter has a length L in a X axis and a width W in a Y axis at right angle to the X axis; at least two spaced apart parallel sections of the prism extend between the side walls, parallel to the Y axis and terminate at the virtual rectangular perimeter, such that each section has a width equal to W and the prism having at least one section bisecting the virtual rectangle parallel to the X axis and terminating at the rectangular perimeter and having a length equal to L, wherein L is a multiple of a constant d when d is equal to the distance between the at least two sections.

2. A set of paving blocks as defined in claim 1, wherein the length of the virtual rectangular perimeter of each prism of the set is expressed as $L_1$ is equal to 3d; $L_2$, is equal to 4d; $L_3$ is equal to 5d; and $L_n$ is equal to (n+2)d.

3. A set of paving blocks as defined in claim 1, wherein at least two of the blocks of the set have different configurations although each prism has a dimension T extending between a top and bottom surface of the prism along an axis Z at right angle to the X axis and the Y axis wherein the dimensions W of the virtual rectangular perimeter and T of each prism are constant.

4. A set of paving blocks as defined in claim 1, wherein the side and end walls of the prism are non linear and the portions of the side walls coincident with the sections parallel to the Y axis and the portions of the end walls coincident with the section parallel to the X axis represent contact areas for contact with adjacent blocks.

5. A set of paving stones as defined in claim 1, where each paving stone has a different configuration and is a molded concrete block and has side walls which are generally parallel, and each block having a virtual rectangular perimeter with a width W which is constant and a thickness T of the respective prism that is constant and a length L of the virtual rectangular prism that can be different for different blocks.

6. A set of paving blocks as defined in claim 1, wherein at least one of the blocks has parallel end walls extending at least partially at an acute angle to the Y axis and a dividing line extends across the block at an angle opposite to the acute angle of the end walls, whereby when the block is split along the dividing line, trapezoidal blocks are formed.

* * * * *